US009303479B2

(12) United States Patent
Kotrla et al.

(10) Patent No.: US 9,303,479 B2
(45) **Date of Patent: *Apr. 5, 2016**

(54) SUBSEA DIFFERENTIAL-AREA ACCUMULATOR

(71) Applicant: Cameron International Corporation, Houston, TX (US)

(72) Inventors: Johnnie E. Kotrla, Katy, TX (US); Mac Kennedy, Houston, TX (US); Nathan Cooper, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/458,048

(22) Filed: Aug. 12, 2014

(65) Prior Publication Data

US 2015/0101822 A1 Apr. 16, 2015

Related U.S. Application Data

(63) Continuation of application No. 13/003,150, filed as application No. PCT/US2009/052709 on Aug. 4, 2009, now Pat. No. 8,833,465.

(60) Provisional application No. 61/086,029, filed on Aug. 4, 2008.

(51) Int. Cl.

| | |
|---|---|
| ***E21B 7/12*** | (2006.01) |
| ***E21B 33/035*** | (2006.01) |
| ***E21B 33/064*** | (2006.01) |
| ***F15B 1/24*** | (2006.01) |
| ***F15B 3/00*** | (2006.01) |
| ***F15B 21/00*** | (2006.01) |
| ***E21B 33/038*** | (2006.01) |
| ***E21B 34/04*** | (2006.01) |

(52) U.S. Cl.

CPC ..... *E21B 33/0355* (2013.01); *E21B 33/038* (2013.01); *E21B 33/064* (2013.01); *E21B 34/04* (2013.01); *F15B 1/24* (2013.01); *F15B 3/00* (2013.01); *F15B 21/006* (2013.01); *F15B 2201/205* (2013.01); *F15B 2201/31* (2013.01)

(58) Field of Classification Search

CPC ..... E21B 34/04
USPC ..... 166/363, 364; 60/143
See application file for complete search history.

(56) References Cited

U.S. PATENT DOCUMENTS

| | | | | | |
|---|---|---|---|---|---|
| 2,790,462 | A | * | 4/1957 | Ashton | 138/31 |
| 3,436,914 | A | * | 4/1969 | Rosfelder | 60/398 |
| 3,487,228 | A | * | 12/1969 | Kriegel | 290/52 |
| 3,614,111 | A | * | 10/1971 | Regan | 251/1.2 |
| 3,677,001 | A | * | 7/1972 | Childers et al. | 60/398 |

(Continued)

*Primary Examiner* — Matthew R Buck
*Assistant Examiner* — Aaron Lembo
(74) *Attorney, Agent, or Firm* — Chamberlain, Hrdlicka

(57) ABSTRACT

An accumulator for hydraulically actuating subsea equipment includes a hydraulic fluid chamber and a gas chamber. The hydraulic fluid chamber is in fluid communication with the subsea equipment and comprises a hydraulic piston slidably received, at least partially, within the hydraulic chamber. The gas chamber comprises a charge piston slidably received within the gas chamber, the charge piston dividing the gas chamber into a first portion and a second portion. The first portion of the gas chamber is configured to receive ambient hydrostatic pressure therein, and the second portion of the gas chamber is configured to receive precharge gas therein.

20 Claims, 3 Drawing Sheets

(56) References Cited

U.S. PATENT DOCUMENTS

| | | | | | |
|---|---|---|---|---|---|
| 3,743,013 | A * | 7/1973 | Harbonn | 166/368 |
| RE28,177 | E * | 10/1974 | England et al. | 303/7 |
| 3,987,708 | A * | 10/1976 | Uhrich | 92/134 |
| 4,095,421 | A * | 6/1978 | Silcox | 60/398 |
| 4,112,687 | A * | 9/1978 | Dixon | 60/641.6 |
| 4,145,959 | A * | 3/1979 | Burden et al. | 92/8 |
| 4,187,682 | A * | 2/1980 | Shen | 60/413 |
| 4,294,284 | A * | 10/1981 | Herd | 137/613 |
| 4,649,704 | A * | 3/1987 | Marsh | 60/415 |
| 4,761,118 | A * | 8/1988 | Zanarini | 417/254 |
| 4,811,558 | A * | 3/1989 | Baugh | 60/281 |
| 4,923,005 | A * | 5/1990 | Laky et al. | 166/55 |
| 5,119,779 | A * | 6/1992 | Plohberger et al. | 123/250 |
| 5,181,696 | A * | 1/1993 | Abe | 267/64.17 |
| 5,807,083 | A * | 9/1998 | Tomoiu | 417/398 |
| 5,919,361 | A * | 7/1999 | Moran | 210/198.2 |
| 6,125,938 | A * | 10/2000 | Garcia-Soule et al. | 166/344 |
| 6,202,753 | B1 * | 3/2001 | Baugh | 166/364 |
| 6,270,064 | B1 * | 8/2001 | Tachikawa | 267/64.15 |
| 6,568,911 | B1 * | 5/2003 | Brightwell et al. | 417/53 |
| 6,729,130 | B1 * | 5/2004 | Lilleland | 60/413 |
| 7,108,006 | B2 * | 9/2006 | Armstrong | 137/14 |
| 7,424,917 | B2 * | 9/2008 | Martin | 166/335 |
| 7,520,129 | B2 * | 4/2009 | Springett | 60/398 |
| 7,628,207 | B2 * | 12/2009 | Leonardi et al. | 166/364 |
| 7,727,392 | B2 * | 6/2010 | DeVoe | 210/257.2 |
| 7,735,563 | B2 * | 6/2010 | Judge et al. | 166/357 |
| 7,780,852 | B2 * | 8/2010 | DeVoe | 210/649 |
| 7,874,155 | B2 * | 1/2011 | McBride et al. | 60/645 |
| 7,934,561 | B2 * | 5/2011 | Ormond | 166/355 |
| 8,181,704 | B2 * | 5/2012 | Fenton | 166/338 |
| 8,225,606 | B2 * | 7/2012 | McBride et al. | 60/508 |
| 8,240,146 | B1 * | 8/2012 | Bollinger | 60/508 |
| 8,448,433 | B2 * | 5/2013 | McBride et al. | 60/508 |
| 2003/0019636 | A1 * | 1/2003 | Robichaux | 166/380 |
| 2003/0037544 | A1 * | 2/2003 | Armstrong | 60/413 |
| 2004/0031622 | A1 * | 2/2004 | Butler et al. | 175/5 |
| 2005/0022996 | A1 * | 2/2005 | Baugh | 166/363 |
| 2005/0074296 | A1 * | 4/2005 | McCarty et al. | 405/224.4 |
| 2008/0104951 | A1 * | 5/2008 | Springett | 60/413 |
| 2008/0185046 | A1 * | 8/2008 | Springett et al. | 137/14 |
| 2009/0127482 | A1 * | 5/2009 | Bamford | 251/1.3 |
| 2011/0232474 | A1 * | 9/2011 | Geiger | 91/159 |

* cited by examiner

SUBSEA DIFFERENTIAL-AREA ACCUMULATOR

CROSS-REFERENCE TO RELATED APPLICATIONS

This application is a continuation of U.S. application Ser. No. 13/003,150, filed on Jan. 7, 2011, which is a 35 U.S.C. §371 national stage application of PCT/US2009/052709 filed Aug. 4, 2009, which claims the benefit of U.S. Provisional Patent Application No. 61/086,029 filed Aug. 4, 2008, all of which are incorporated herein by reference in their entireties for all purposes.

BACKGROUND

Deepwater accumulators provide a supply of pressurized working fluid for the control and operation of subsea equipment, such as through hydraulic actuators and motors. Typical subsea equipment may include, but is not limited to, blowout preventers (BOPs) that shut off the well bore to secure an oil or gas well from accidental discharges to the environment, gate valves for the control of flow of oil or gas to the surface or to other subsea locations, or hydraulically actuated connectors and similar devices.

Accumulators are typically divided vessels with a gas section and a hydraulic fluid section that operate on a common principle. The principle is to precharge the gas section with pressurized gas to a pressure at or slightly below the anticipated minimum pressure required to operate the subsea equipment. Hydraulic fluid can be added to the accumulator in the separate hydraulic fluid section, increasing the pressure of the pressurized gas and the hydraulic fluid. The hydraulic fluid introduced into the accumulator is therefore stored at a pressure at least as high as the precharge pressure and is available for doing hydraulic work.

Accumulators generally come in three styles—the bladder type having a balloon type bladder to separate the gas from the fluid, the piston type having a piston sliding up and down a seal bore to separate the fluid from the gas, and the float type with a float providing a partial separation of the fluid from the gas and for closing a valve when the float approaches the bottom to prevent the escape of the charging gas. A fourth type of accumulator is pressure compensated for depth and adds the nitrogen precharge pressure plus the ambient seawater pressure to the working fluid.

The precharge gas can be said to act as a spring that is compressed when the gas section is at its lowest volume/greatest pressure and released when the gas section is at its greatest volume/lowest pressure. Accumulators are typically precharged in the absence of hydrostatic pressure and the precharge pressure is limited by the pressure containment and structural design limits of the accumulator vessel under surface ambient conditions. Yet, as accumulators are used in deeper water, the efficiency of conventional accumulators decreases as application of hydrostatic pressure causes the gas to compress, leaving a progressively smaller volume of gas to charge the hydraulic fluid. The gas section must consequently be designed such that the gas still provides enough power to operate the subsea equipment under hydrostatic pressure even as the hydraulic fluid approaches discharge and the gas section is at its greatest volume/lowest pressure.

For example, accumulators at the surface typically provide 3000 psi working fluid maximum pressure. In 1000 feet of seawater the ambient pressure is approximately 465 psi. For an accumulator to provide a 3000 psi differential at 1000 ft. depth, it must actually be precharged to 3000 psi plus 465 psi, or 3465 psi.

At slightly over 4000 ft. water depth, the ambient pressure is almost 2000 psi, so the precharge would be required to be 3000 psi plus 2000 psi, or 5000 psi. This would mean that the precharge would equal the working pressure of the accumulator and any fluid introduced for storage may cause the pressure to exceed the working pressure and accumulator failure.

At progressively greater hydrostatic operating pressures, the accumulator thus has greater pressure containment requirements at non-operational (no ambient hydrostatic pressure) conditions.

The accumulator design must also take into account human error contingencies. For example, removal of the external ambient hydrostatic pressure without evacuating the fluid section of the accumulator to reestablish the original gas section precharge pressure may result in failure due to gas section pressures exceeding the original precharge pressures.

As shown in FIGS. 1 and 2, accumulators may be included, for example, as part of a subsea BOP stack assembly 10 assembled onto a wellhead assembly 11 on the sea floor 12. The BOP stack assembly 10 is connected in line between the wellhead assembly 11 and a floating rig 14 through a subsea riser 16. The BOP stack assembly 10 provides emergency fluid pressure control of fluid in the wellbore 13 should a sudden pressure surge escape the wellbore 13. The BOP stack assembly thus prevents damage to the floating rig 14 and the subsea riser 16 from fluid pressure exceeding design capacities.

The BOP stack assembly 10 includes a BOP lower riser package 18 that connects the riser 16 to a BOP package 20. The BOP package 20 includes a frame 22, BOPs 23, and accumulators 24 that may be used to provide back up hydraulic fluid pressure for actuating the BOPs 23. The accumulators 24 are incorporated into the BOP package 20 to maximize the available space and leave maintenance routes clear for working on the components of the subsea BOP package 20. However, the space available for other BOP package components such as remote operated vehicle (ROV) panels and mounted controls equipment has become harder to establish due to the increasing number and size of the accumulators 24 required to be considered for operation in deeper water depths. Depending on the depth of the wellhead assembly 11 and the design of the BOPs 23, numerous accumulators 24 must be included on the frame 22, taking up valuable space on the frame 22 and adding weight to the subsea BOP stack assembly 10. The accumulators 24 are also typically installed in series where the failure of any one accumulator 24 prevents the additional accumulators 24 from functioning.

The inefficiency of precharging accumulators under non-operational conditions requires large aggregate accumulator volumes that increase the size and weight of the subsea equipment. Yet, offshore rigs are moving further and further offshore to drill in deeper and deeper water. Because of the ever increasing envelop of operation, traditional accumulators have become unmanageable with regards to quantity and location. In some instances, it has even been suggested that in order to accommodate the increasing demands of the conventional accumulator system, a separate subsea skid may have to be run in conjunction with the subsea BOP stack in order to provide the required volume necessary at the limits of the water depth capability of the subsea BOP stack. With rig operators increasingly putting a premium on minimizing size and weight of the drilling equipment to reduce drilling costs, the size and weight of all drilling equipment must be optimized.

BRIEF DESCRIPTION OF THE DRAWINGS

For a more detailed description of the embodiments, reference will now be made to the following accompanying drawings.

DETAILED DESCRIPTION OF THE EMBODIMENTS

Figure 1:
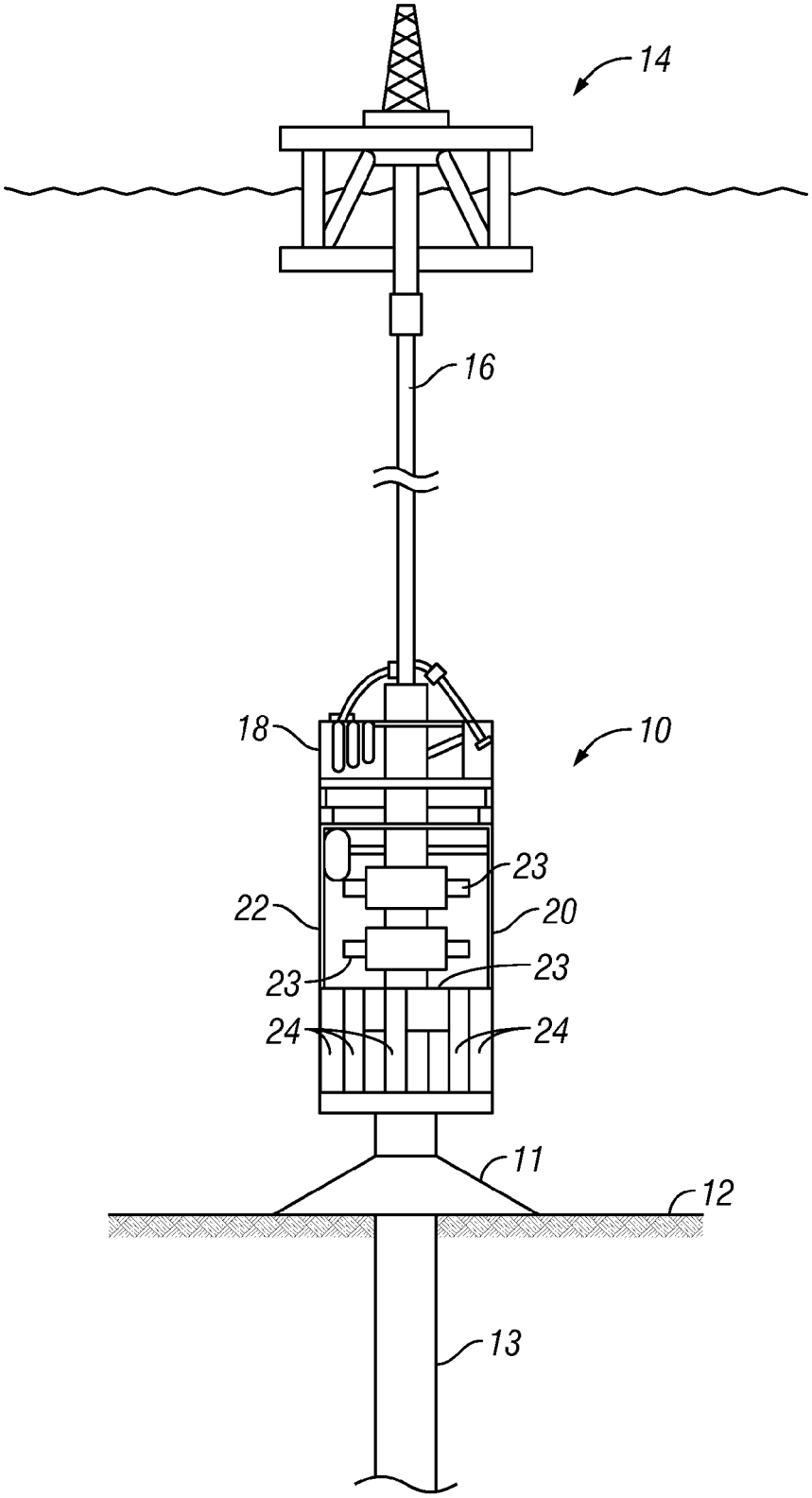
FIG. 1 is a schematic of a subsea BOP stack assembly connecting a wellhead assembly to a floating rig through a subsea riser.
Figure 2:
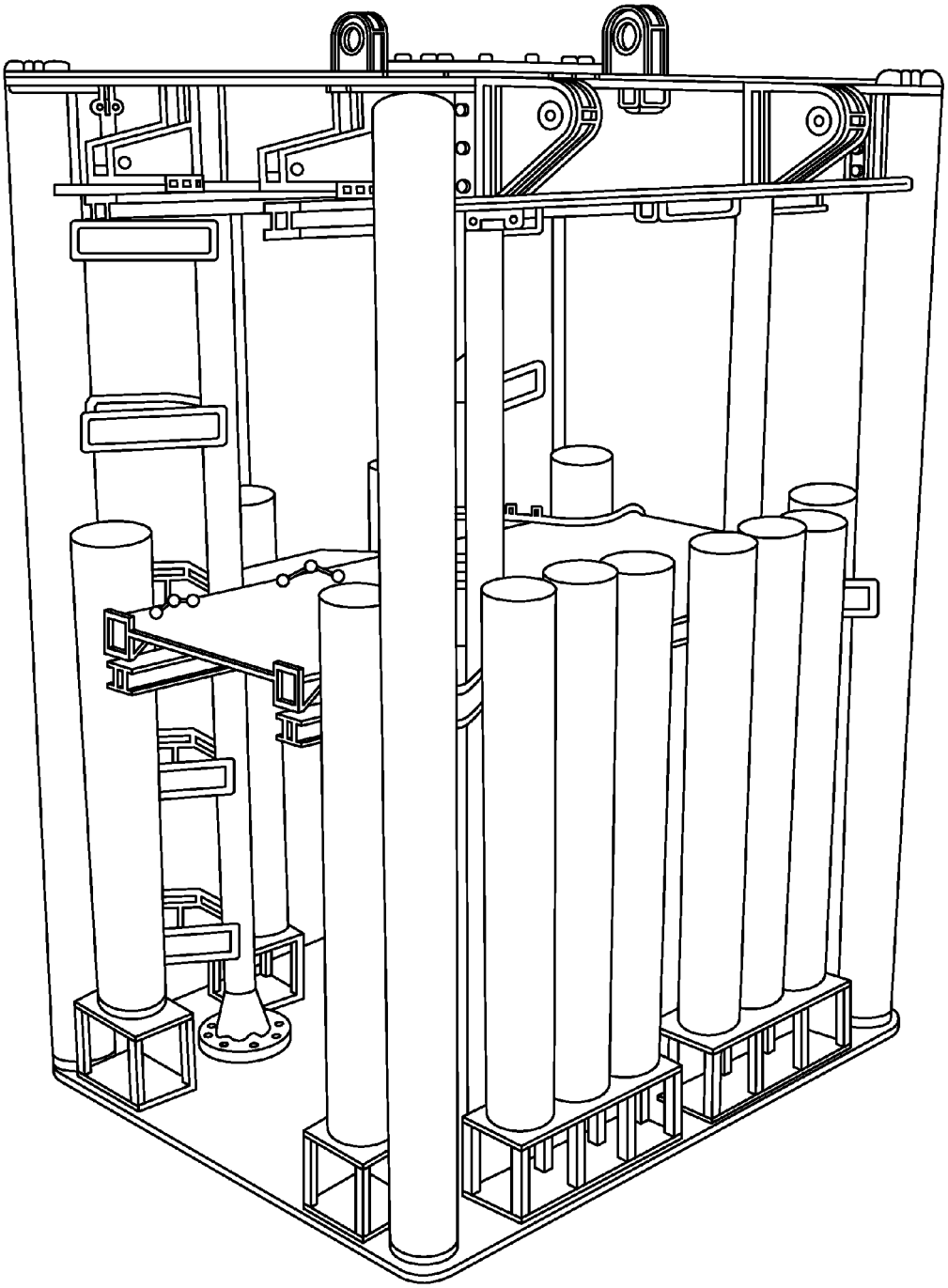
FIG. 2 is a perspective view of a BOP package of the BOP stack assembly of FIG. 1.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Figure 3:
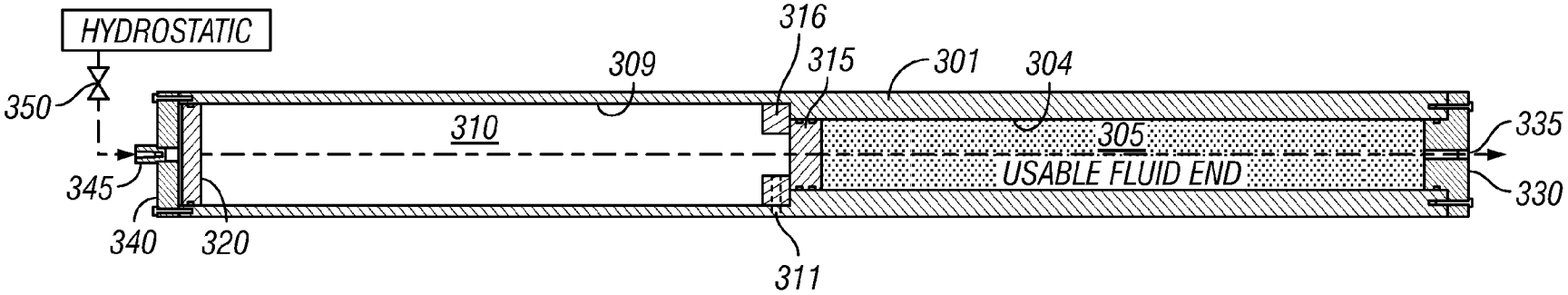
FIG. 3 a cross-section view of an accumulator in accordance with one embodiment of the claimed subject matter.

In FIG. 3, an accumulator 300 includes an accumulator body 301 with a hydraulic fluid portion 304 and a charge fluid portion 309. The hydraulic fluid portion 304 partially forms a hydraulic fluid chamber 305 and the charge fluid portion 309 partially forms a precharge gas chamber 310. An end cap 330 having a hydraulic fluid port 335 seals off an end of the hydraulic fluid portion 304 at one end of the accumulator 300. Another end cap 340 having a hydrostatic pressure port 345 seals off an end of the charge fluid portion 309 at the other end of the accumulator 300.

A hydraulic piston 315 is slidably and sealingly mounted in the hydraulic fluid portion 304. The hydraulic fluid chamber 305 is defined in the hydraulic fluid portion 304 between the hydraulic piston 315 and the end cap 330. A charge piston 320 is slidably and sealingly mounted in the charge fluid portion 309. The precharge gas chamber 310 is defined in the charge fluid portion 309 between the charge piston 320 and the hydraulic piston 315.

At the surface before installation on the sea floor, a precharge gas, such as nitrogen, is provided into the precharge gas chamber 310 and pressurized according to a predetermined depth at which the accumulator will operate and the pressure needed to operate the subsea equipment, such as the rams of the BOPs. A precharge pressure port (not shown) may be, for example, in the side of the accumulator body 301 or in the charge piston 320. During pressurization of the precharge gas chamber 310, the hydraulic piston 315 moves towards the end cap 330. After placement on the seafloor, hydraulic fluid is pumped into the hydraulic fluid chamber 305, which moves the hydraulic piston 315 towards the opposing end of the hydraulic fluid portion 304 until contacting a shoulder 316. The hydraulic fluid may be any suitable hydraulic fluid and may also include performance enhancing additives such as a lubricant. The accumulator 300 is then ready to provide pressurized hydraulic fluid to operate the rams of the BOPs.

In normal operation, the force of the precharge gas acting against the hydraulic piston 315 is sufficient to operate the subsea equipment with the hydraulic fluid stored in the hydraulic fluid chamber 305. However, in case additional force is needed, the accumulator 300 further includes a valve 350, which communicates ambient hydrostatic pressure through the port 345 when open. That hydrostatic pressure acts against the charge piston 320 and increases the pressure within the precharge gas chamber 310. The increased pressure of the precharge gas in turn acts against the hydraulic piston 315 to increase the pressure of the hydraulic fluid. As hydraulic fluid is forced out of the hydraulic fluid chamber 305 by movement of the hydraulic piston 315, the charge piston 320 will move in the same direction with hydrostatic pressure continuing to act against the charge piston 320. Because hydrostatic pressure acts against the charge piston 320, the effective increase in pressure of the hydraulic fluid is increased proportional to the difference in piston diameters, giving a multiplier effect to the hydrostatic pressure upon the hydraulic piston 315. The hydrostatic pressure provides a boost in the force acting on the subsea equipments, such as hydraulic rams of a blowout preventer, which may be useful in an emergency situation. As the hydraulic rams close and the hydraulic fluid exits the accumulator 300, seawater will flow into the accumulator to apply the constant hydrostatic pressure. Thus, the force applied by the hydraulic rams remains constant between the fully opened and fully closed positions.

Figure 4:
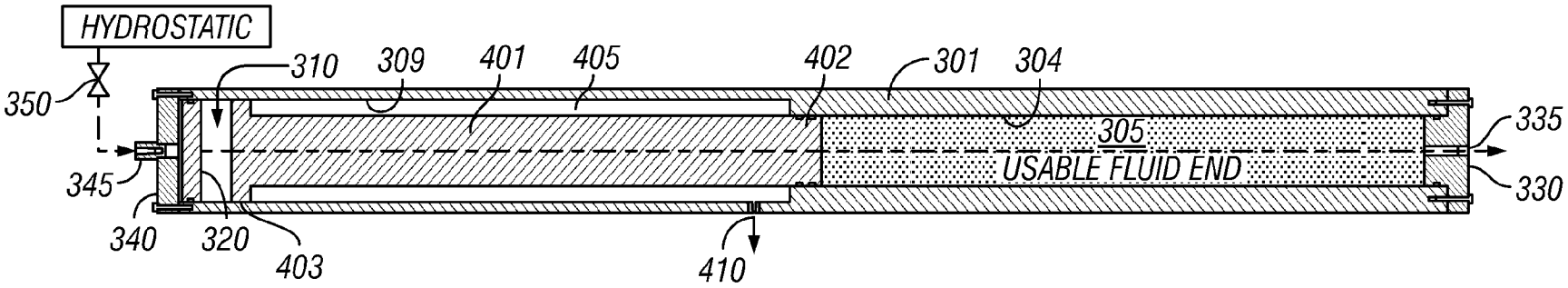
FIG. 4 is a cross-section view of an accumulator in accordance with one embodiment of the claimed subject matter.

Referring now to FIG. 4, another accumulator 400 is shown that shares many of the same components as the accumulator 300 shown in FIG. 3. In the accumulator of FIG. 4 however the hydraulic piston 315 is extended to form a piston body 401 that includes a hydraulic diameter portion 402 and a charge diameter portion 403. The hydraulic diameter portion 402 slidably and sealingly engages the inside of the hydraulic fluid portion 304 of the accumulator body 301, and the charge diameter portion 403 slidably and sealingly engages the inside of the charge fluid portion 309 of the accumulator body 301. Although shown as a solid piston body, those having ordinary skill in the art will appreciate that the piston body 401 may be a single hollow piece or any assembly of cylinders that results in a mechanical connection between the hydraulic diameter portion 402 and the charge diameter portion 403.

The hydraulic fluid chamber 305 is partially defined by the hydraulic fluid portion 402 of the piston body 401 and the end cap 330. A buffer chamber 405 is defined as the annular space between the outer diameter of the piston body 401 and the inner diameter of the charge fluid portion 309 of the accumulator body 301. At the surface before installation on the sea floor, the precharge gas is provided into the precharge gas chamber 310 defined between the charge piston 320 and the charge diameter portion 403 of the piston body 401 and pressurized according to a predetermined operating depth and pressure. As shown, the charge diameter portion 403 of the piston body 401 is larger than the hydraulic diameter portion 402. Thus, the necessary precharge pressure may be reduced proportional to the difference in effective piston area of the two portions of the piston body 401.

The pressure in the precharge gas chamber 310 at the surface causes the piston body 401 to move towards end cap 330, which reduces the size of the buffer chamber 405. Fluid, such as air, contained in the buffer chamber 405 may be vented through port 410. If port 410 is closed after the piston body 401 has traveled fully towards the end cap 330, the buffer chamber 405 will have a vacuum when the hydraulic fluid chamber 305 is filled with hydraulic fluid at the sea floor. By having a vacuum, none of the pressure in the precharge gas chamber 310 is counterbalanced by the buffer chamber 405. If air in the buffer chamber 405 is not vented, actuation of the piston body 401 will compress the air in the buffer chamber 405, thereby providing a pressure counterbalance to the precharge gas pressure.

In normal operation, the force of the precharge gas acting against the hydraulic piston 315 is sufficient to operate the subsea equipment with the hydraulic fluid stored in the hydraulic fluid chamber 305. However, in case additional force is needed, the accumulator 300 further includes a valve 350, which communicates ambient hydrostatic pressure through the port 345 when open. That hydrostatic pressure acts against the charge piston 320 and increases the pressure within the precharge gas chamber 310. The increased pressure of the precharge gas in turn acts against the charge diameter portion 403 of the piston body 401 to increase the pressure of the hydraulic fluid. As hydraulic fluid is forced out of the hydraulic fluid chamber 305 by movement of the hydraulic diameter portion 402 of the piston body 401, the piston body 401 will move in the same direction with hydrostatic pressure continuing to act against the charge diameter portion 403 of the piston body 401. Because hydrostatic pressure acts against charge diameter portion of the piston body 401 via the charge piston 320, the effective increase in pressure of the hydraulic fluid is increased proportional to the difference in piston diameters, giving a multiplier effect to the hydrostatic pressure upon the hydraulic diameter portion 402 of the piston body 401. The hydrostatic pressure provides a boost in the force acting on the subsea equipment, such as hydraulic rams of a blowout preventer, which may be useful in an emergency situation. As the hydraulic rams close and the hydraulic fluid exits the accumulator 300, seawater will flow into the accumulator to apply the constant hydrostatic pressure. Thus, the force applied by the hydraulic rams remains constant between the fully opened and fully closed positions.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An accumulator for hydraulically actuating subsea equipment, the accumulator comprising:

a hydraulic fluid chamber in fluid communication with the subsea equipment and comprising an inner cavity;

a gas chamber with an inner cavity larger than the inner cavity of the hydraulic fluid chamber;

a hydraulic piston slidably received, at least partially, within the hydraulic fluid chamber;

a charge piston slidably received within the gas chamber;

the hydraulic piston and the charge piston forming a precharge volume therebetween.

2. The accumulator of claim 1, further comprising:

a hydraulic fluid port in fluid communication between the hydraulic fluid chamber and the subsea equipment; and a pressure port for receiving pressure to provide a force on the side of the charge piston opposite from the hydraulic piston.

3. The accumulator of claim 2, wherein the pressure port receives ambient pressure to provide a force on the opposite side of the charge piston from the precharge gas.

4. The accumulator of claim 3, further comprising:

a valve selectively controlling the exposure of the pressure port to ambient pressure.

5. The accumulator of claim 1, wherein the precharge volume is pressurizable by a precharge gas between the hydraulic piston and the charge piston.

6. The accumulator of claim 1, further comprising:

a precharge pressure port for receiving the precharge gas between the hydraulic piston and the charge piston.

7. The accumulator of claim 1, wherein the hydraulic piston and the charge piston are separable from each other.

8. The accumulator of claim 1, wherein the hydraulic piston includes a small diameter portion slidably and sealingly mounted in the hydraulic fluid chamber and connected to a larger diameter portion slidably and sealingly mounted in the gas chamber.

9. The accumulator of claim 1, wherein the hydraulic piston is fully received within the hydraulic fluid chamber.

10. The accumulator of claim 1, wherein the hydraulic piston and the charge piston are coupled to prevent relative movement therebetween.

11. An accumulator for hydraulically actuating subsea equipment, the accumulator comprising:

a hydraulic fluid chamber in fluid communication with the subsea equipment and comprising a hydraulic piston slidably received, at least partially, within the hydraulic chamber; and a gas chamber comprising a charge piston slidably received therein, the charge piston dividing the gas chamber into a first portion and a second portion;

the first portion of the gas chamber being configured to receive ambient hydrostatic pressure therein; and the second portion of the gas chamber being configured to receive precharge gas therein.

12. The accumulator of claim 11, further comprising a body with the hydraulic fluid chamber and the gas chamber formed within the body, and wherein the hydraulic piston and the charge piston sealingly engage the body, the body further comprising:

a hydraulic fluid port in fluid communication between the hydraulic fluid chamber and the subsea equipment; and a pressure port for receiving ambient pressure to provide a force on the side of the charge piston opposite from the hydraulic piston.

13. The accumulator of claim 12, further comprising:

a valve selectively controlling the exposure of the pressure port to ambient pressure.

14. The accumulator of claim 11, wherein the hydraulic piston and the charge piston are separable from each other.

15. The accumulator of claim 11, wherein the hydraulic piston is fully received within the hydraulic fluid chamber.

16. The accumulator of claim 11, wherein the hydraulic piston and the charge piston are coupled to prevent relative movement therebetween.

17. The accumulator of claim 11, wherein the gas chamber comprises an inner cavity larger than an inner cavity of the hydraulic fluid chamber.

18. An accumulator for a subsea blowout preventer unit including a blowout preventer, comprising:

a body including a hydraulic fluid chamber and a precharge gas chamber, wherein the hydraulic fluid chamber has a smaller inner diameter than the precharge gas chamber;

a hydraulic fluid port in fluid communication between the hydraulic fluid chamber and the subsea blowout preventer;

a hydraulic piston slidably and sealingly mounted in the hydraulic fluid chamber;

a charge piston slidably and sealingly mounted in the precharge gas chamber and unconnected with the hydraulic piston; and a pressure port for receiving pressure to provide a force on the opposite side of the charge piston from the hydraulic piston.

19. The accumulator of claim 18, wherein the precharge gas chamber is pressurizable by a precharge gas disposed between the hydraulic piston and the charge piston.

20. The accumulator of claim 19, wherein the pressure port receives ambient pressure to provide a force on the opposite side of the charge piston from the precharge gas.

* * * * *